US008584289B2

(12) United States Patent
Im et al.

(10) Patent No.: US 8,584,289 B2
(45) Date of Patent: Nov. 19, 2013

(54) LAUNDRY TREATMENT MACHINE AND WASHING METHOD THEREFOR

(75) Inventors: Myong Hum Im, Seoul (KR); Byung Keol Choi, Seoul (KR); Woo Young Kim, Seoul (KR); Kyung Chul Woo, Seoul (KR); Kyeong Hwan Kim, Seoul (KR); Han Gil Park, Seoul (KR); Soo Young Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 1121 days.

(21) Appl. No.: 12/510,508

(22) Filed: Jul. 28, 2009

(65) Prior Publication Data

US 2010/0064447 A1 Mar. 18, 2010

(30) Foreign Application Priority Data

Sep. 12, 2008 (KR) ..... 10-2008-0090210

(51) Int. Cl.
*D06F 35/00* (2006.01)

(52) U.S. Cl.
USPC ..... 8/158; 8/147; 8/148; 68/12.01; 134/95.3; 134/18

(58) Field of Classification Search
USPC ..... 8/147, 148, 12.01, 12.02, 12.05, 12.19, 8/12.21, 12.23, 16, 158, 139, 13 R; 134/95.3, 18
See application file for complete search history.

(56) References Cited

U.S. PATENT DOCUMENTS

| | | | | |
|---|---|---|---|---|
| 5,150,489 | A | 9/1992 | Kaji et al. | |
| 6,418,758 | B1 * | 7/2002 | Ikeda et al. | 68/12.06 |
| 6,871,370 | B2 * | 3/2005 | Choi et al. | 8/159 |
| 7,376,997 | B2 * | 5/2008 | Kim et al. | 8/159 |
| 2001/0027579 | A1 | 10/2001 | Kwon | |
| 2008/0282479 | A1 * | 11/2008 | Darby | 8/159 |

FOREIGN PATENT DOCUMENTS

| | | |
|---|---|---|
| CN | 1319695 | 10/2001 |
| CN | 1746384 | 3/2006 |
| EP | 1 772 548 | 4/2007 |
| FR | 2 075 274 | 10/1971 |
| WO | WO 02/057530 | 7/2002 |

OTHER PUBLICATIONS

European Search Report dated Mar. 21, 2013.
Chinese Office Action dated Feb. 9, 2011. (Application No. 200910168854X).

* cited by examiner

*Primary Examiner* — Eric Golightly
*Assistant Examiner* — Thomas Bucci
(74) *Attorney, Agent, or Firm* — KED & Associates LLP

(57) ABSTRACT

A laundry treatment machine and a washing method therefor are provided. During a rinsing operation, the laundry treatment machine may rotate a drum while supplying fluid into the drum. In addition, the laundry treatment machine may control a fluid circulation device to circulate the fluid, and thus, to spray the circulated fluid into the drum during the rotation of the drum. The drum realizes at least one of first through fourth motions. The laundry treatment machine may perform various rinsing operations in consideration of the fluid level in a tub.

15 Claims, 8 Drawing Sheets

LAUNDRY TREATMENT MACHINE AND WASHING METHOD THEREFOR

CROSS REFERENCE TO RELATED APPLICATION

This application claims priority to Korean Patent Application No. 10-2008-0090210, filed in Korea on Sep. 12, 2008, the disclosure of which is incorporated herein by reference in its entirety.

BACKGROUND

1. Field

A laundry treatment machine and a washing method for a laundry treatment machine are provided.

2. Background

Laundry treatment machines and washing methods are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
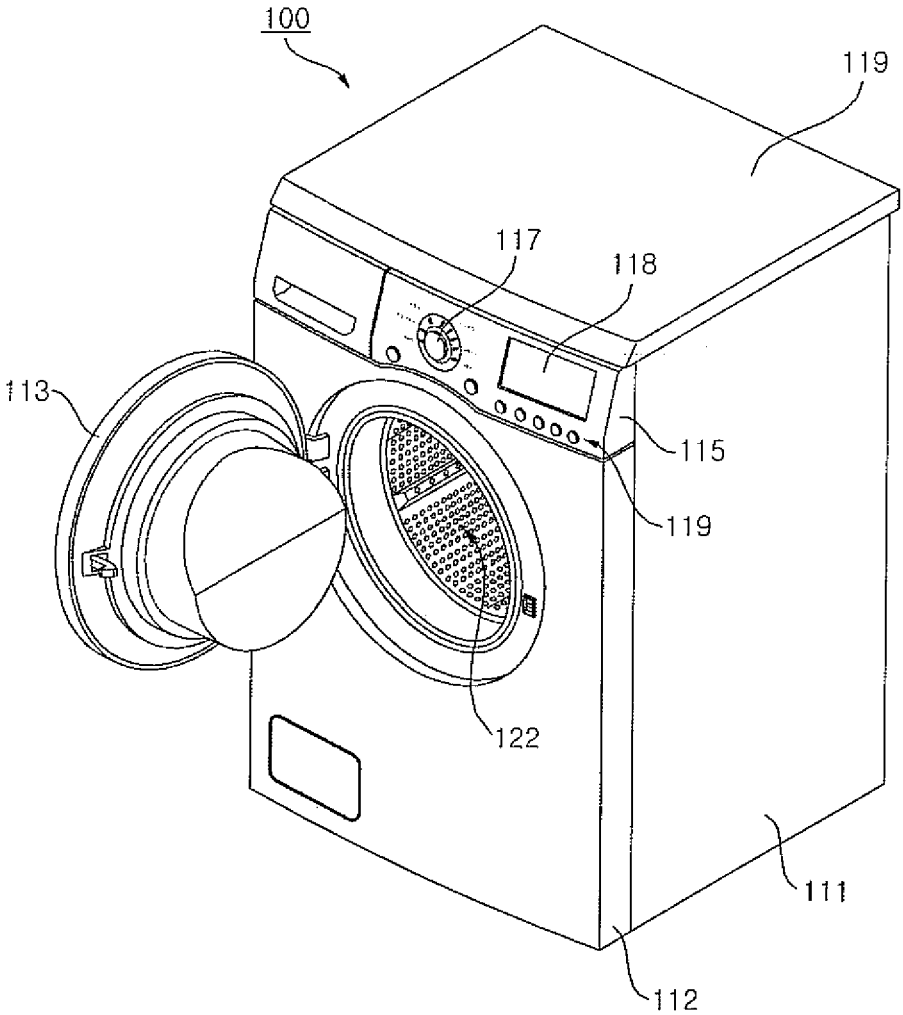
FIG. 1 is a front perspective view of a laundry treatment machine according to an embodiment.

Embodiments will now be described more fully with reference to the accompanying drawings, in which like reference numerals have been used to indicate like elements.

In general, laundry treatment machines mix a fluid, such as water, with a detergent and supply the mixture into a drum. After the mixture is supplied into the drum, a washing operation for washing laundry is performed by rotating the drum. When the washing operation is complete, a fluid not mixed with a detergent is supplied into the drum by an external fluid source, and a rinsing operation for rinsing the laundry is performed. When the rinsing operation is completed, the fluid in the drum is discharged, and a dehydration operation for dehydrating the wet laundry is performed.

Figure 2:
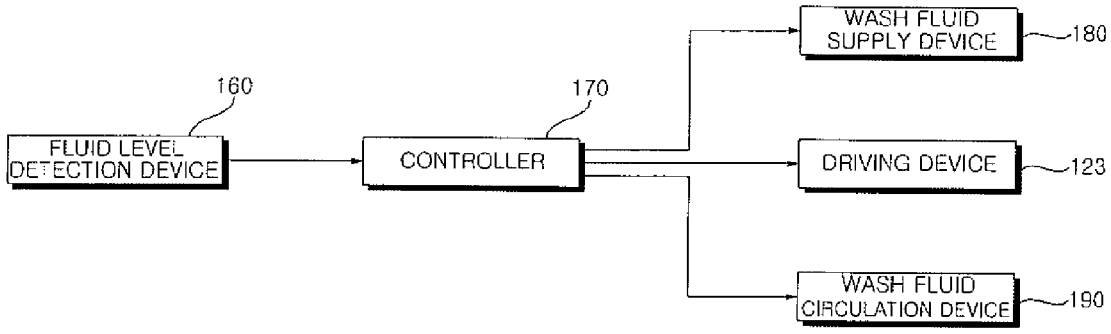
FIG. 2 is a block diagram of the laundry treatment machine of FIG. 1.
Figure 3:
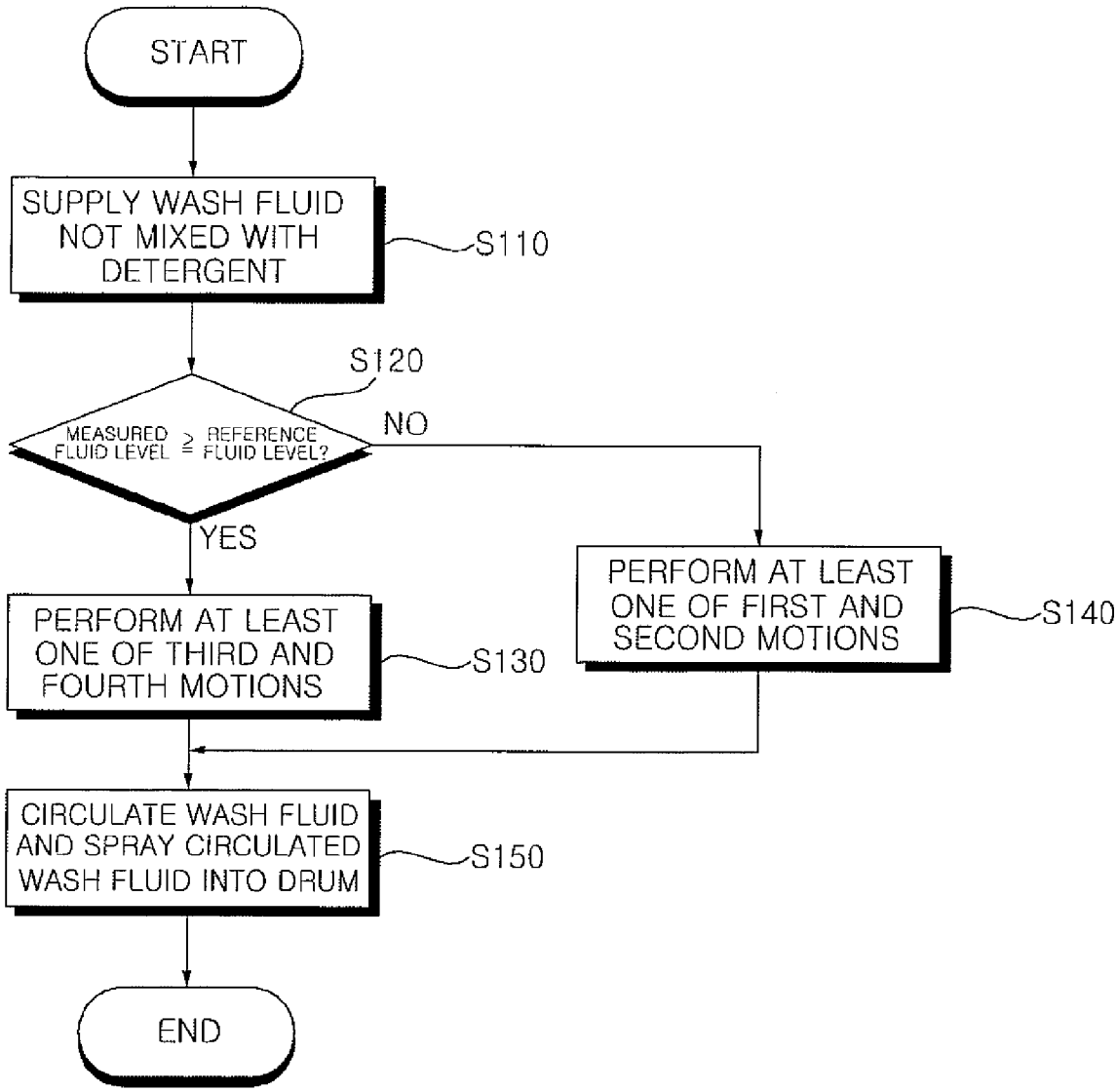
FIG. 3 is a flowchart of a washing method for a laundry treatment machine, such as that shown in FIG. 1.
Figure 4A:
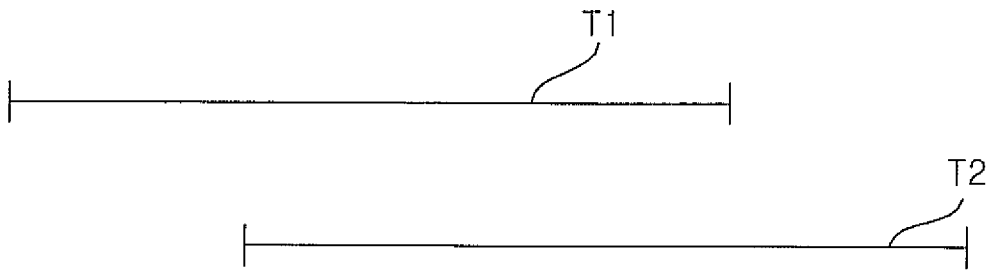
FIGS. 4A-4C are diagrams illustrating a relationship between a time period during which the drum shown in FIG. 1 rotates and a time period during which a fluid supply device shown in FIG. 2 supplies fluid.
Figure 4B:
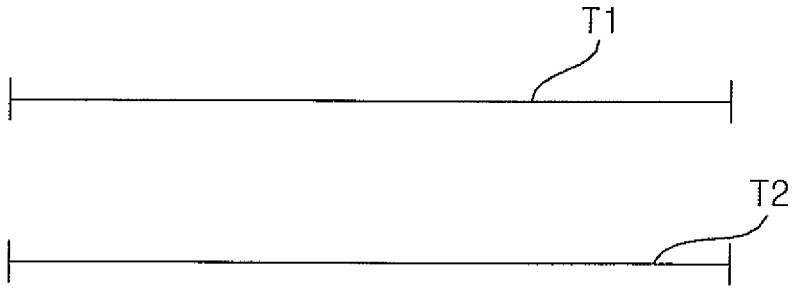
Figure 4C:
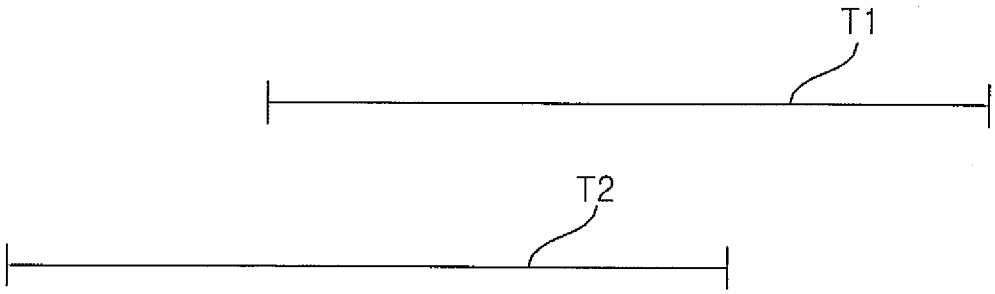
Figure 5A:
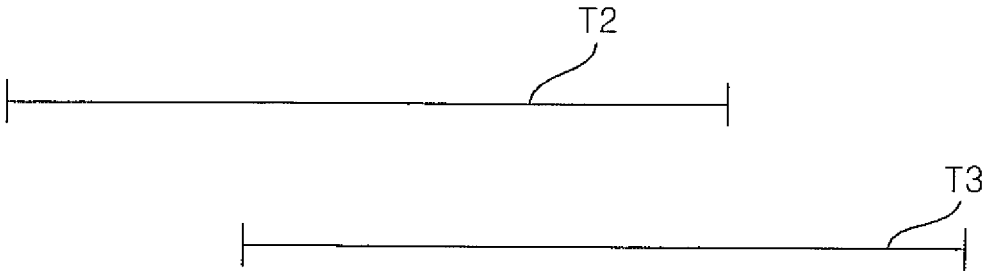
FIGS. 5A-5C are diagrams illustrating a relationship between the time period during which the drum shown in FIG. 1 rotates and a time period during which a fluid circulation device shown in FIG. 2 is driven.
Figure 5B:
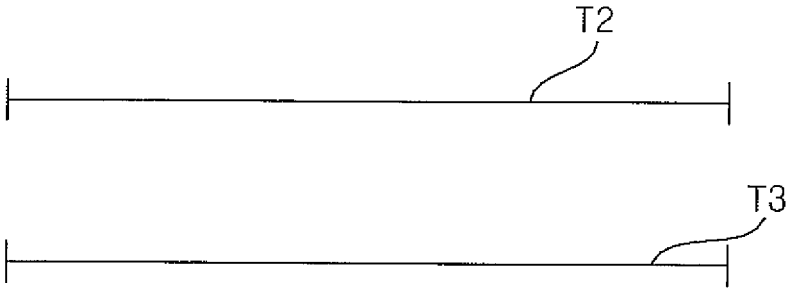
Figure 5C:
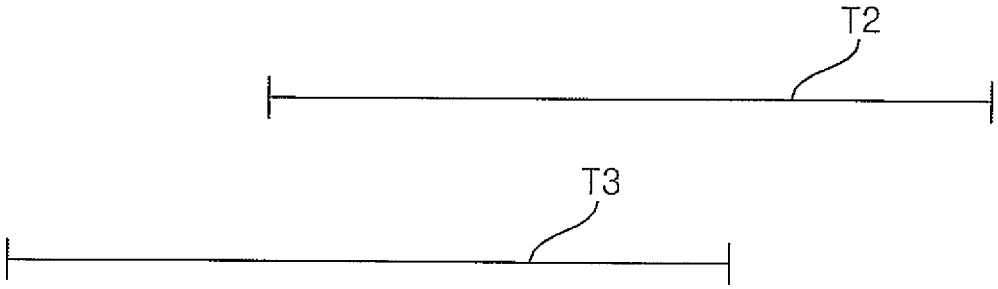

FIG. 1 illustrates a front perspective view of a laundry treatment machine 100 according to an embodiment. FIG. 2 is a block diagram of the laundry treatment machine 100. FIG. 3 is a flow chart of a washing method for a laundry treatment machine 100, such as that shown in FIG. 1. FIGS. 4A-4C are diagrams illustrating a relationship between a time period during which a drum of the laundry treatment machine of FIGS. 1-2 rotates and a time period during which a wash fluid supply device 180 of the laundry treatment machine of shown in FIGS. 1-2 supplies wash fluid. FIGS. 5A-5C are diagrams illustrating a relationship between the time period during which the drum 122 rotates and a time period during which the wash fluid supply device 180 is driven.

Referring to FIGS. 1 through 4C, the laundry treatment machine 100 may include a cabinet 110, a drum 122 rotatably disposed in the cabinet 110, a tub (not shown) which contains the drum 122 therein, a fluid supply device 180 that supplies a fluid, such as water, with or without a detergent mixed therein into the drum 122 and the tub, and a controller 170 that controls the drum 122 to rotate while controlling the fluid supply device 180 to supply a fluid not mixed with a detergent into the drum 122 during a rinsing operation.

When the laundry treatment machine 100 begins to operate, a fluid supplied by an external fluid source is mixed with a detergent, and the mixture is supplied into the drum 122. Thereafter, the drum 122 begins to rotate, and thus, a washing operation for washing laundry is performed. When the washing operation is completed, a fluid not mixed with a detergent is supplied into the laundry treatment machine 100. Thereafter, the drum 122 begins to rotate again, and thus, a rinsing operation for rinsing laundry is performed. Thereafter, a drainage operation for discharging used wash fluid is performed.

More specifically, the controller 170 may control the fluid supply device 180 to supply fluid into the drum 122 and the tub, in step S110. Thereafter, a fluid level detection device 160, which may be disposed, for example, in the tub, may measure a fluid level in the drum 122. Thereafter, the fluid level detection device 160 may transmit the result of the measurement to the controller 170. The controller 170 may determine which of first through fourth motions is to be performed by controlling a driving device 123. The first motion may correspond to rotating the drum 122 once by controlling the driving device 123 to consecutively apply a first directional torque to the drum 122. The first directional torque may be a forward or clockwise (CW) directional torque. The second motion may correspond to rotating the drum 122 in a first direction and in a second direction so as to lift up the laundry in the drum 122 to a height less than half a height of the drum 122. The first direction may be a forward or CW direction and the second direction may be a reverse or counterclockwise (CCW) direction. The third motion may correspond to rotating the drum 122 in the first direction and in the second direction so as to lift up laundry in the drum 122 to a height greater than the height of the drum 122 and then to drop the laundry. The fourth motion may correspond to rotating the drum 122 once in the first direction by applying a first directional torque and then a second directional torque to the drum 122. The first directional torque may be a forward or CW directional torque and the second directional torque may be a backward or CCW directional torque. That is, the controller 170 may control the drum 122 to perform at least one of the first through fourth motions.

In order to realize the first motion, the controller 170 may control the driving device 123 to consecutively apply a first directional torque to the drum 122. More specifically, the controller 170 may rotate the drum 122 once in the first direction by controlling the driving device 123 to consecutively apply a first directional torque to the drum 122.

In order to realize the second motion, the controller 170 may rotate the drum 122 in the first direction and in the second direction so as to lift up the laundry in the drum 122 to a height less than half the height of the drum 122. More specifically, the controller 170 may rotate the drum 122 in the first direction by controlling the driving device 123 to apply a first directional torque to the drum 122. Thereafter, if the laundry in the drum 122 is lifted up to a height less than half the height of the drum 122, the controller 170 may control the driving device 123 to apply a second directional torque to the drum 122. If a second directional torque is applied to the drum 122, the drum 122 may temporarily stop rotating. Then, the laundry in the drum 122 may be dropped from less than half the height of the drum 122. If the application of a second directional torque to the drum 122 continues, the drum 122 may begin to rotate in the second direction. Then, the laundry in the drum 122 may rotate in the second direction along with the drum 122. The movement of the laundry in the drum 122 during the rotation of the drum 122 in the second direction may be the same as or similar to the movement of the laundry in the drum 122 during the rotation of the drum 122 in the first direction.

In order to realize the third motion, the controller 170 may control the driving device 123 to rotate the drum 122 in the first direction and in the second direction. As a result, the laundry in the drum 122 may be lifted up to a height greater than half the height of the drum 122, and may then be dropped. In order to perform the third motion, the controller 170 may control the drum 122 and the driving device 123 in the same manner as or a similar manner to that used to perform the second motion.

In order to realize the fourth motion, the controller 170 may control the driving device 123 to apply a first directional torque and a second directional torque to the drum 122 so as to rotate the drum 122 once in the first direction. If the driving device 123 applies a first directional torque to the drum 122, the drum 122 may rotate in the first direction. Then, the controller 170 may control the driving device 123 to apply a second direction to the drum 122 during the rotation of the drum 122 in the first direction. If a second directional torque is applied to the drum 122 during the rotation of the drum 122 in the first direction, the drum 122 may temporarily stop rotating, and the laundry in the drum 122 may be separated from the drum 122 and may be dropped. Thereafter, the controller 170 may control the driving device 123 again to apply a first directional torque to the drum 122. In short, the controller 170 may control the drum 122 and the driving device 123 and may thus realize various motions.

The controller 170 may control the drum 122 to rotate while supplying fluid not mixed with a detergent. That is, during a rinsing operation, the controller 170 may control the fluid supply device 180 to supply fluid not mixed with a detergent and may control the drum 122 to rotate. The fluid level detection device 160 may measure the fluid level in the drum 122 and may transmit the measured fluid level to the controller 170. The controller 170 may compare the measured fluid level with a reference fluid level, in step S120. If the measured fluid level is higher than the reference fluid level, the controller 170 may control the drum 122 to perform at least one of the third and fourth motions, in step S130. On the other hand, if the measured fluid level is lower than the reference fluid level, the controller 170 may control the drum 122 to perform at least one of the first and second motions, in step S140. In short, the controller 170 may control the driving device 123 in consideration of the fluid level in the drum 122 and may thus control the drum 122 to perform at least one of the first through fourth motions while minimizing resistance to the drum 122 caused by fluid.

The controller 170 may control a time period T1 during which the fluid supply device 180 supplies fluid and a time period T2 during which the drum 122 rotates to overlap at least partially with each other.

More specifically, referring to FIG. 4A, the controller 170 may begin to drive the fluid supply device 180. A predetermined amount of time after a beginning of the operation of the fluid supply device 180, the controller 170 may begin to rotate the drum 122. That is, the controller 170 may begin to rotate the drum 122 after waiting until the fluid level in the drum 122 reaches a predetermined level.

Alternatively, referring to FIG. 4B, the controller 170 may control the time period T1 and the time period T2 to coincide with each other. That is, the controller 170 may rotate the drum 122 while driving the fluid supply device 180. Therefore, the laundry in the drum 122 may be able to uniformly absorb fluid supplied by the fluid supply device 180 due to the rotation of the drum 122.

Still alternatively, referring to FIG. 4C, the controller 170 may begin to rotate the drum 122 and may then control the fluid supply device 180 to begin to supply fluid during the rotation of the drum 122. That is, a predetermined amount of time after the beginning of the rotation of the drum 122, the controller 170 may begin to drive the fluid supply device 180. Therefore, the controller 170 may uniformly distribute the laundry in the drum 122 by rotating the drum 122, and may control the laundry in the drum 122 to easily absorb fluid supplied by the fluid supply device 180.

The laundry treatment machine 100 may also include a wash fluid circulation device 190, which circulates wash fluid, such as water, in the tub and sprays the circulated wash fluid into the drum 122. The controller 170 may control the wash fluid circulation device 190 to circulate the wash fluid in the tub, and thus, to spray the circulated wash fluid in the tub into the drum 122, step S150. The controller 170 may control the time period T2 and a time period T3 during which the wash fluid circulation device 190 is driven to overlap at least partially with each other.

More specifically, referring to FIG. 5A, the controller 170 may begin to rotate the drum 122. A predetermined amount of time after the beginning of the rotation of the drum 122, the controller 170 may begin to drive the wash fluid circulation device 190, and thus, to spray the wash fluid in the tub into the drum 122. Therefore, the controller 170 may control the laundry in the drum 122 to uniformly absorb wash fluid by circulating the wash fluid and spraying the wash fluid onto the laundry in the drum 122.

Alternatively, referring to FIG. 5B, the controller 170 may control the time period T2 and the time period T3 to coincide with each other. More specifically, the controller 170 may rotate the drum 122 while driving the wash fluid circulation device 190, and thus, to spray the wash fluid in the tub into the drum 122. Therefore, the laundry in the drum 122 may be able to uniformly absorb wash fluid due to the rotation of the drum 122, thereby facilitating a rinsing operation by allowing.

Still alternatively, referring to FIG. 5C, the controller 170 may begin to drive the wash fluid circulation device 190. A predetermined amount of time after the beginning of the operation of the wash fluid circulation device 190, the controller 170 may begin to rotate the drum 122. Therefore, the drum 122 may begin to operate after the spraying of fluid onto the laundry in the drum 122. Thus, it is possible to facilitate a rinsing operation due to fluid absorbed into the laundry in the drum 122.

Figure 6:
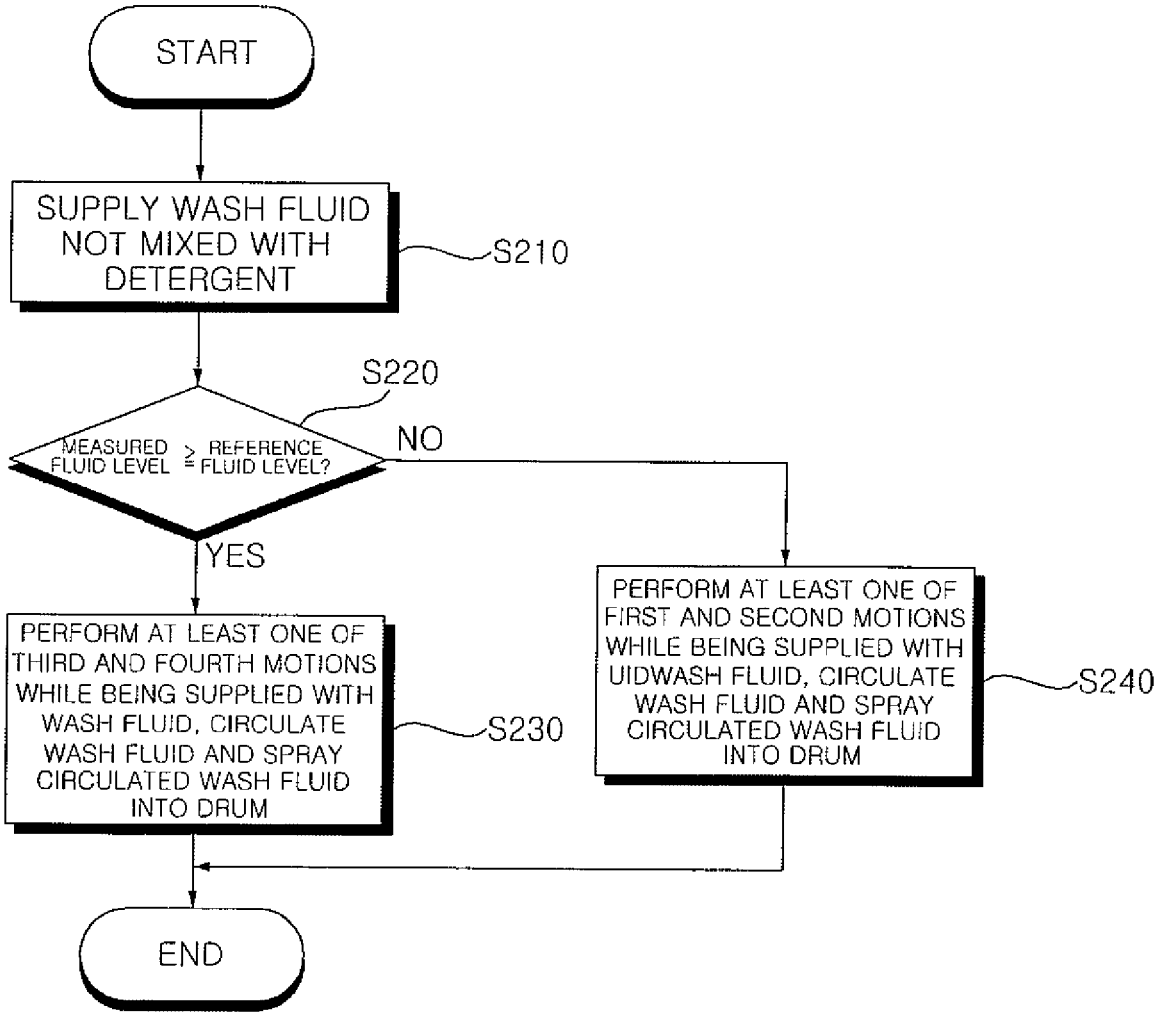
FIG. 6 is a flowchart of a washing method for a laundry treatment machine according to another embodiment.
Figure 7A:
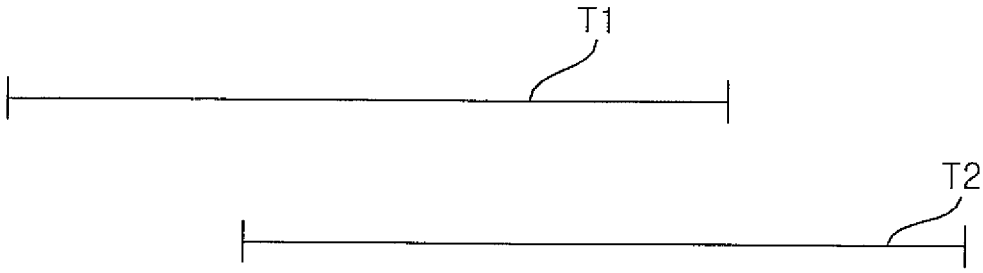
FIGS. 7A-7C are diagrams illustrating a relationship between a time period during which a drum of the laundry treatment machine of FIG. 6 rotates and a time period during which a fluid supply device of the laundry treatment machine of FIG. 6 supplies fluid.
Figure 7B:
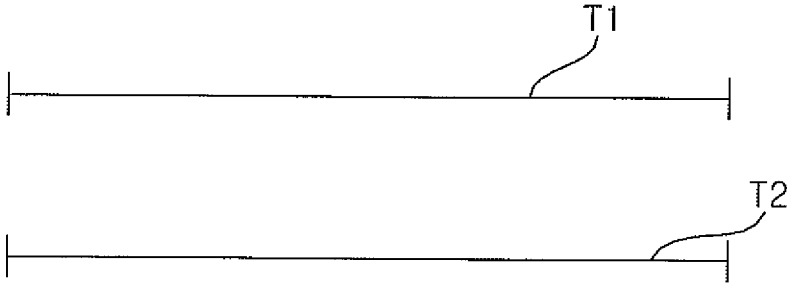
Figure 7C:
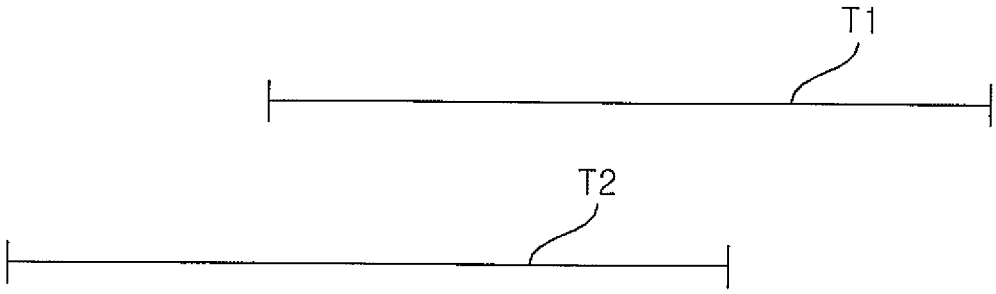
Figure 8A:
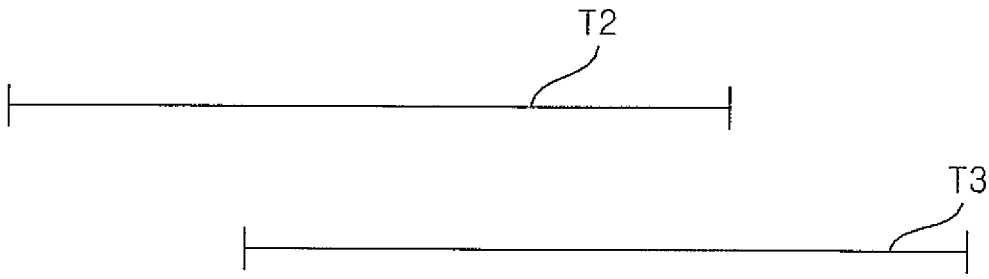
FIGS. 8A-8C are diagrams illustrating a relationship between a time period during which the drum of the laundry treatment machine of FIG. 6 rotates and a time period during which the fluid circulation device of the laundry treatment machine of FIG. 6 is driven.
Figure 8B:
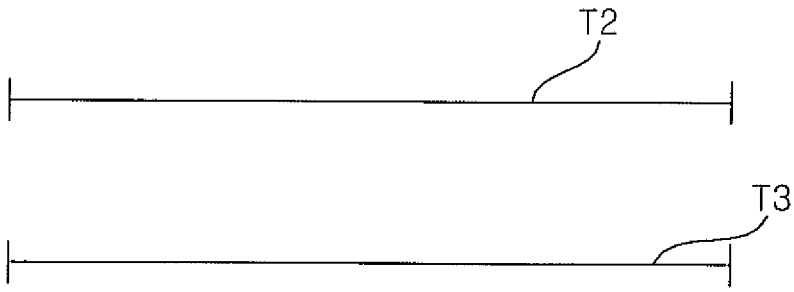
Figure 8C:
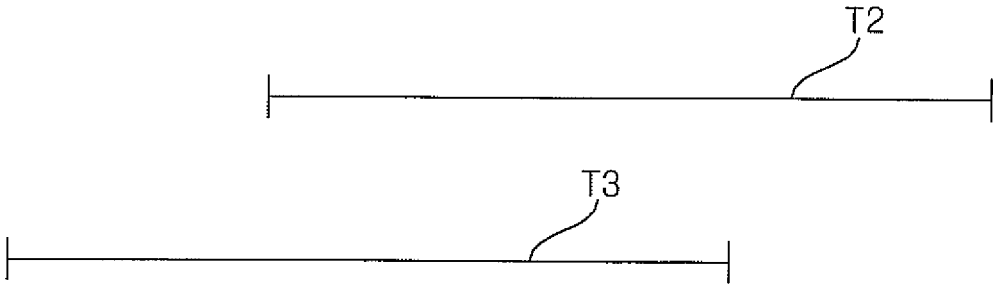

FIG. 6 is a flowchart of a washing method for a laundry treatment machine according to another embodiment. FIGS. 7A-7C are diagrams illustrating a relationship between a time period during which a drum of the laundry treatment machine of FIG. 6 rotates and a time period during which a fluid supply device of the laundry treatment machine of FIG. 6 supplies fluid. FIGS. 8A-8C are diagrams illustrating a relationship between the time period during which the drum of the laundry treatment machine of FIG. 6 rotates and a time period during which the fluid circulation device of the laundry treatment machine of FIG. 6 is driven. The embodiment of FIG. 6 will hereinafter be described in detail, mainly focusing on differences from the embodiment of FIG. 3.

The laundry treatment machine in which the embodiment of FIG. 6 may be implemented, is similar to the laundry treatment device of FIG. 1 and may include a drum (not shown) configured to receive laundry therein; a tub (not shown) that contains the drum therein; a fluid supply device (not shown) that supplies fluid into the drum and the tub; a fluid circulation device (not shown) that circulates the fluid in the drum, and thus, sprays the circulated fluid into the drum; a fluid level detection device disposed in the tub that measures a fluid level in the drum; and a controller (not shown) that controls the drum to rotate while controlling the fluid supply device to supply fluid not mixed with a detergent into the drum during a rinsing operation, and controls the fluid circulation device to circulate fluid, and thus, to spray the circulated fluid into the drum.

That is, when a rinsing operation begins, the controller may control the fluid supply device to supply fluid not mixed with a detergent into the tub and the drum. Thereafter, the fluid level detection device may measure the fluid level in the drum and may transmit the measured fluid level to the controller, in step S210. Thereafter, the controller may determine which of the first through fourth motions is to be performed based on the measured fluid level. More specifically, if the measured fluid level is higher than a reference fluid level, in step S220, the controller may control the drum to perform at least one of the third and fourth motions while being supplied with fluid, and may control the fluid circulation device to spray fluid into the drum, in step S230. On the other hand, if the measured fluid level is lower than the reference fluid level, in step S220, the controller may control the drum to perform at least one of the first and second motions while being supplied with fluid, and may control the fluid circulation device to spray fluid into the drum, in step S240. Therefore, the controller may control the rotation of the drum in consideration of the fluid level in the drum and may thus reduce resistance to the drum caused by the rotation of the drum. In addition, the controller may control the rotation of the drum and a rinsing operation may to be smoothly performed.

The controller may control a time period T2 during which the drum rotates and a time period T1 during which the fluid supply device supplies fluid to overlap at least partially with each other. More specifically, referring to FIG. 7A, the controller may begin to drive the fluid supply device. A predetermined amount of time after the beginning of the operation of the fluid supply device, the controller may begin to rotate the drum. That is, the controller may begin to rotate the drum after waiting until the fluid level in the drum reaches a predetermined level.

Alternatively, referring to FIG. 7B, the controller may control the time period T1 and the time period T2 to coincide with each other. More specifically, the controller may drive the fluid supply device while rotating the drum. Thus, the laundry in the drum may be able to uniformly absorb fluid supplied by the fluid supply device due to the rotation of the drum.

Still alternatively, referring to FIG. 7C, the controller may begin to rotate the drum. A predetermined amount of time after the beginning of the rotation of the controller, the controller may begin to drive the fluid supply device. Therefore, the controller may uniformly distribute the laundry in the drum by rotating the drum, and may control the laundry in the drum to easily absorb fluid supplied by the fluid supply device.

The controller may control the time period T2 and a time period T3 during which the fluid circulation device is driven to overlap at least partially with each other. More specifically, referring to FIG. 8A, the controller may begin to rotate the drum. A predetermined amount of time after the beginning of the rotation of the drum, the controller may begin to drive the fluid circulation device, and thus, to spray the fluid in the tub into the drum. Therefore, the controller may control the laundry in the drum to uniformly absorb fluid by circulating the fluid and spraying the fluid onto the laundry in the drum.

Alternatively, referring to FIG. 8B, the controller may control the time period T2 and the time period T3 to coincide with each other. More specifically, the controller may rotate the drum while driving the fluid circulation device and thus to spray the fluid in the tub into the drum. Therefore, the laundry in the drum may be able to uniformly absorb fluid due to the rotation of the drum, thereby facilitating a rinsing operation by allowing.

Still alternatively, referring to FIG. 8C, the controller may begin to drive the fluid circulation device. A predetermined amount of time after the beginning of the operation of the fluid circulation device, the controller may begin to rotate the drum. Therefore, the drum may begin to operate after the spraying of fluid onto the laundry in the drum. Thus, it is possible to facilitate a rinsing operation due to fluid absorbed into the laundry in the drum.

Embodiments disclosed herein provide a laundry treatment machine that may reduce an amount of time taken to supply wash fluid during a rinsing operation and a washing method of the laundry treatment machine.

Embodiments disclosed herein provide a laundry treatment machine that may include a drum that contains laundry and in which laundry is washed; a tub that contains the drum; a wash fluid supply device that supplies wash fluid provided by an external fluid source into the drum and the tub; and a control unit or controller that controls the drum to rotate while being supplied with a wash fluid not mixed with a detergent by the wash fluid supply device during a rinsing operation for rinsing the laundry.

Embodiments disclosed herein provide a laundry treatment machine that may include a drum that contains laundry and in which the laundry is washed; a tub that contains the drum; a wash fluid supply device that supplies wash fluid provided by an external fluid source into the drum and the tub; a wash fluid circulation device that circulates wash fluid in the tub and thus sprays the circulated wash fluid into the drum; and a control unit or controller that controls the drum to rotate while being supplied with wash fluid not mixed with a detergent by the wash fluid supply device during a rinsing operation for rinsing the laundry and controls the wash fluid circulation device to circulate the wash fluid in the tub and thus to spray the circulated wash fluid into the drum.

Embodiments disclosed herein provide a washing method that may include performing a rinsing operation for rinsing laundry, wherein the performing of the rinsing operation may include supplying wash fluid not mixed with a detergent, rotating a drum during the supplying of the wash fluid and circulating the wash fluid and spraying the circulated wash fluid into the drum during the rotating of the drum.

Embodiments disclosed herein provide a washing method that may include performing a rinsing operation for rinsing laundry, wherein the performing of the rinsing operation may include supplying wash fluid not mixed with a detergent, circulating the wash fluid and spraying the circulated wash fluid into the drum during the supplying of the wash fluid, and rotating the drum during the circulating of the wash fluid.

A control unit or controller may control a drum to rotate while being supplied with wash fluid by a wash fluid supply device. Thus, it may be possible to perform a rinsing operation while supplying wash fluid into the drum. Therefore, it may be possible to reduce the time taken to perform a rinsing operation, and thus, to improve energy efficiency. In addition, it may be possible to considerably reduce the time taken to perform a washing operation.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A laundry treatment machine, comprising:

a tub;

a drum rotatably installed in the tub and configured to receive therein laundry to be washed;

a driving device configured to rotate the drum;

a fluid supply device that supplies fluid provided by an external source into the drum and the tub;

a fluid circulation device that circulates the fluid in the tub and sprays the circulated fluid into the drum; and a controller that controls, from substantially a beginning of a rinsing operation for rinsing the laundry, the driving device to rotate the drum, while controlling the fluid supply device to supply the fluid into the drum and the tub, and controlling the fluid circulation device to circulate the fluid and spray the circulated fluid into the drum.

2. The laundry treatment machine of claim 1, wherein the controller controls the driving device to rotate the drum prior to the fluid being supplied by the fluid supply device into the drum and the tub.

3. The laundry treatment machine of claim 1, wherein the controller controls a time period during which the fluid supply device supplies the fluid into the drum and the tub and a time period during which the driving device rotates the drum to overlap at least partially with each other.

4. The laundry treatment machine of claim 1, wherein the controller controls a time period during which the driving device rotates the drum and a time period during which the fluid circulation device is operated to overlap at least partially with each other.

5. The laundry treatment machine of claim 1, wherein the controller controls the driving device to provide at least one of first through fourth motions to the drum, wherein the first motion corresponds to the driving device rotating the drum by consecutively applying a first directional torque to the drum, wherein the second motion corresponds to the driving device rotating the drum in a first direction and in a second direction, which is a reverse of the first direction, so as to lift up the laundry in the drum to a height less than half a height of the drum, wherein the third motion corresponds to the driving device rotating the drum greater than 120° in the first direction and in the second direction so as to lift up and drop the laundry in the drum, and wherein the fourth motion corresponds to the driving device rotating the drum in the first direction by applying the first directional torque and a second directional torque, which is a reverse of the first directional torque, to the drum.

6. The laundry treatment machine of claim 5, further comprising a fluid level detection device disposed in the drum, wherein, if a fluid level in the tub is lower than a reference fluid level, the controller controls the driving device to perform at least one of the first and second motions.

7. The laundry treatment machine of claim 5, further comprising a fluid level detection device disposed in the drum, wherein, if a fluid level in the tub is higher than a reference fluid level, the controller controls the driving device to perform at least one of the third and fourth motions.

8. The laundry treatment machine of claim 1, wherein the laundry treating machine is a front loading laundry treating machine.

9. The laundry treatment machine of claim 1, wherein the controller controls the fluid supply device to supply the fluid, which is not mixed with a detergent, for rinsing the laundry.

10. The laundry treatment machine of claim 3, wherein the controller controls the driving device to start the rotation of the drum after a predetermined time period of starting the supply of the fluid into the drum and the tub by the fluid supply device.

11. The laundry treatment machine of claim 3, wherein the controller controls the driving device to rotate the drum and the fluid supply device to supply the fluid into the drum and the tub to start simultaneously.

12. The laundry treatment machine of claim 3, wherein the controller controls the fluid supply device to start the supply of the fluid into the drum and the tub after a predetermined time period of starting the rotation of the drum by the driving device.

13. The laundry treatment machine of claim 4, wherein the controller controls the fluid circulation device to start the circulation of the fluid and to spray the circulated fluid after a predetermined time period of starting the rotation of the drum by the driving device.

14. The laundry treatment machine of claim 4, wherein the controller controls the driving device to rotate the drum and the fluid circulation device to circulate the fluid and to spray the circulated fluid into the drum to start simultaneously.

15. The laundry treatment machine of claim 4, wherein the controller controls the driving device to start the rotation of the drum after a predetermined time period of starting the fluid circulation device to circulate the fluid and to spray the circulated fluid into the drum.

* * * * *